United States Patent [19]

Raubenheimer

[11] Patent Number: 4,608,167

[45] Date of Patent: Aug. 26, 1986

[54] SKIMMING WEIRS

[75] Inventor: Johann N. Raubenheimer, Bedfordview, South Africa

[73] Assignee: Fahet NV, Curacao, Netherlands Antilles

[21] Appl. No.: 769,744

[22] Filed: Aug. 27, 1985

[30] Foreign Application Priority Data

Nov. 2, 1984 [ZA] South Africa ..... 84/8586

[51] Int. Cl.[4] ..... E04H 3/20

[52] U.S. Cl. ..... 210/242.1; 210/242.3; 210/169; 4/490

[58] Field of Search ..... 210/169, 242.1, 242.3, 210/776, 923, 538; 4/512, 490

[56] References Cited

U.S. PATENT DOCUMENTS

| | | | |
|---|---|---|---|
| 3,314,543 | 4/1967 | Nash | 4/512 |
| 3,316,934 | 5/1967 | Sowers | 210/169 |
| 3,555,574 | 1/1971 | Stanwood | 4/512 |
| 3,688,909 | 9/1972 | Titus et al. | 210/242.3 |
| 3,724,666 | 4/1973 | Johnson | 210/169 |
| 3,792,499 | 2/1974 | Whitaker | 4/512 |
| 3,939,505 | 2/1976 | Gross | 210/169 |
| 4,145,292 | 3/1979 | in'tVeld | 210/242.3 |
| 4,405,458 | 9/1983 | McHugh, Jr. | 210/242.1 |

*Primary Examiner*—Benoit Castel
*Assistant Examiner*—Linda S. Evans
*Attorney, Agent, or Firm*—Birch, Stewart, Kolasch & Birch

[57] ABSTRACT

A skimmer weir is composed of an upper flap 10 and a lower flap 11 hinged together. The flap 11 is guided for up and down movement and is formed with serrations 9 engaging with serrations 15 to prevent upward movement after the flap 10 is tilted.

2 Claims, 2 Drawing Figures

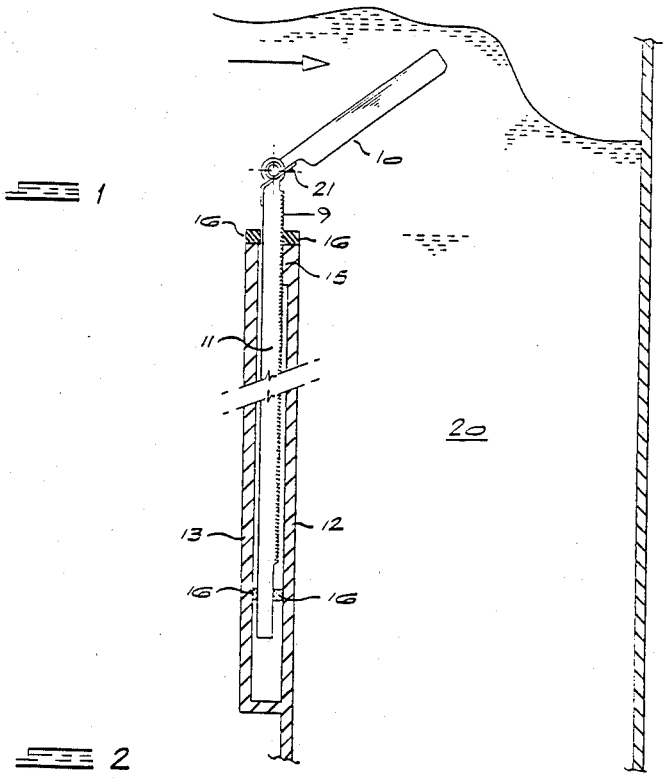
1
10
21
9
16
16
15
11
20
13
12
16
16
2
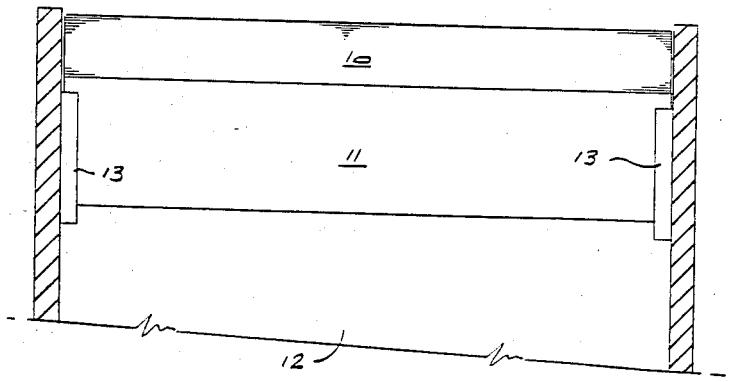
10
11
13
13
12

SKIMMING WEIRS

BACKGROUND TO THE INVENTION

This invention relates to skimming weirs of the kind used on skimmer boxes of swimming pools.

Usually such a weir consists of a pivoted flap with a certain degree of buoyancy. The flap tilts in the stream of water to ensure that a thin layer of water passes over the tip of the flap. The flap adjusts itself to the water level and also to the flow over its tip.

If a skimmer box is narrow, a conventional weir may end up as a lid, if a conventional pivotal action is used.

It is an object of the invention to provide a skimmer weir which can adapt to a variety of water levels and yet pivot over a relatively narrow area.

SUMMARY OF THE INVENTION

According to the invention a skimmer weir is composed of two flaps hinged together, the upper flap being buoyant, and the lower flap being guided for substantially vertical movement in a fixed path.

Further according to the invention, the lower flap is provided with stops which limit its upward movement and preferably also with means inhibiting upward movement once the upper flap bends under the flow of a stream of water.

DESCRIPTION OF THE DRAWINGS

FIG. 1 is a sectional side view of a skimmer according to the invention, and

FIG. 2 is a face view.

DESCRIPTION OF AN EMBODIMENT

The illustrated skimmer has a buoyant flap 10 hinged to a lower flap 11. The flap 11 is guided at both ends in slots formed between a backing 12 and a front piece 13.

As can be seen from FIG. 1, the flap 11 is formed at its edges with series of serrations 9 and the backing 12 also has serrations 15. A stop 16 prevents the flap 11 from moving out of the slots.

In use, with no suction applied to the zone 20 behind the skimmer the flap 10 and 11 float vertically in line and the tip of the flap 10 is at the top of the water surface. As the level in the zone 20 drops due to suction being applied, the flap 10 tilts to the position shown in FIG. 1. At the same time the flap 11 has a sideways force applied to it so that the serrations interengage. The flap assembly cannot now move up and down, but the flap 10 can tilt in response to the flow of the water.

A spring 21 applies a light bias to the flap 10 so that it does not bend too low below the flow of water.

The flap 10 serves to give adjustments for different flow rates while the lower flap 11 gives adjustments for different water levels in the pool.

I claim:

1. A skimmer weir composed of buoyant upper flap and a lower flap, said two flaps being hinged together, means for guiding said lower flap for substantially vertical movement in a fixed path, stop means for limiting the upward movement of said lower flap, and means inhibiting upward movement of said lower flap once said upper flap bends under the flow of a stream of water.

2. The weir claimed in claim 1 including a spring applying a light upward bias to said upper flap.

* * * * *